US006955050B2

(12) United States Patent
Perkins et al.

(10) Patent No.: US 6,955,050 B2
(45) Date of Patent: Oct. 18, 2005

(54) THERMAL STORAGE UNIT AND METHODS FOR USING THE SAME TO HEAT A FLUID

(75) Inventors: David E. Perkins, Austin, TX (US); Robert S. Hudson, Austin, TX (US)

(73) Assignee: Active Power, Inc., Austin, TX (US)

( * ) Notice: Subject to any disclaimer, the term of this patent is extended or adjusted under 35 U.S.C. 154(b) by 0 days.

(21) Appl. No.: 10/738,825

(22) Filed: Dec. 16, 2003

(65) Prior Publication Data

US 2005/0150226 A1 Jul. 14, 2005

(51) Int. Cl.[7] ..... F01K 13/00; F01K 13/02; F01K 3/00; F01K 1/00

(52) U.S. Cl. ..... 60/645; 60/652; 60/659; 165/902; 165/DIG. 539

(58) Field of Search ..... 60/645, 652, 659; 165/10, 236, 902, DIG. 539

(56) References Cited

U.S. PATENT DOCUMENTS

| | | | | |
|---|---|---|---|---|
| 4,483,364 | A | 11/1984 | Ayler | 137/334 |
| 4,756,154 | A | 7/1988 | Minardi et al. | 60/269 |
| 5,024,058 | A | 6/1991 | Shekleton et al. | 60/752 |
| 6,493,507 | B2 * | 12/2002 | Salyer | 165/10 |

FOREIGN PATENT DOCUMENTS

| | | | | |
|---|---|---|---|---|
| JP | 56075911 A | * | 6/1981 | F01K 1/00 |
| JP | 03095334 A | * | 4/1991 | F24F 5/00 |

OTHER PUBLICATIONS

Schmidt F. W. et al., "Design Optimization of a Single Fluid, Solid Sensible Heat Storage Unit", Journal of Heat Transfer, Transactions of the ASME, May 1977, vol. 99, pp. 174-179.

Krane R. J., "A Second Law Analysis of a Thermal Energy Storage System With Joulean Heating of the Storage Element", Annual Meeting of the American Society of Mechanical Engineers, ASME Paper 85 WA/HT-19, Nov. 1985.

Geyer M. et al., "Evaluation of the Dual Medium Storage at the IEA/SSPS Project in Almeria (Spain)", 8412-0986-3/86/0869-181 American Chemical Society, 1986, pp. 820-827.

Tamme R. et al., "High Temperature Thermal Storage Using Salt/Ceramic Phase Change Materials", 8412-0986-3/86/0869-187 American Chemical Society, 1986, pp. 846-849.

(Continued)

*Primary Examiner*—Sheldon J Richter
(74) *Attorney, Agent, or Firm*—Fish & Neave IP Group of Ropes & Gray LLP; Robert W. Morris; Hassan Albakri

(57) ABSTRACT

A thermal storage unit having at least one annular flow channel formed between an inner and outer member is provided. The thermal storage unit uses conventional mill products to create annular flow channels that economically maximize the surface area of flow in contact with the thermal mass included in the inner and outer members. This enables the thermal storage unit to economically provide heat storage as well as effective heat delivery and pressure containment for a fluid flowing through the annular channel.

88 Claims, 6 Drawing Sheets

OTHER PUBLICATIONS

Tracey T. R. et al., "Economical High Temperature Sensible Heat Storage Using Molten Nitrate Salt", 8412-0986-3/86/0869-188 American Chemical Society, 1986, pp. 850-855.
Krane R. J., "A Second Law Analysis of the Optimum Design and Operation of Thermal Energy Storage Systems", International Journal of Heat and Mass Transfer, 1987, vol. 30, No. 1, pp. 43-57.
Geyer M. A., "Thermal Storage for Solar Power Plants", Solar Power Plants Fundamentals, Technology, Systems, Economics, 1991, chapter 6, pp. 199-214.
Taylor M. J. et al., "Second Law Optimizing of a Sensible Heat Thermal Energy Storage System With a Distributed Storage Element—Part I: Development of the Analytical Model", Journal of Energy Resources Technology, Transactions of the ASME, Mar. 1991, vol. 113, pp. 20-26.
Jotshi C.K. et al., "Heat Transfer Characteristics of a High Temperature Sensible Heat Storage Water Heater Using Cast Iron as a Storage Material", Proceedings of the 31st Intersociety Energy Conversion Engineering Conference, 1996, vol. 3, pp. 2099-2103.
"Survey of Thermal Storage for Parabolic Trough Power Plants", National Renewable Energy Laboratory, NREL/SR-550-27925, Sep. 2000.
Jotshi C.K. et al., "A Water Heater Using Very High-Temperature Storage and Variable Thermal Contact Resistance", International Journal of Energy Research, Jun. 4, 2001, pp. 891-898.

* cited by examiner

THERMAL STORAGE UNIT AND METHODS FOR USING THE SAME TO HEAT A FLUID

BACKGROUND OF THE INVENTION

This invention relates to thermal storage units (TSUs). More particularly, this invention relates to TSUs that provide sensible heat thermal energy storage and delivery in a way that increases efficiency and reduces costs compared to known TSUs.

TSUs are well known and are often used in power delivery systems, such as compressed air storage (CAS) systems and thermal and compressed air storage (TACAS) systems. Such systems, often used to provide an available source of electrical power, often use compressed air to drive a turbine which powers an electrical generator.

In TACAS systems, it is desirable to heat the compressed air prior to reaching the inlet port of the turbine. It is known that heated air, as opposed to ambient or cool air, enables the turbine to operate more efficiently. Therefore, a mechanism or system is needed to heat the air before providing it to the turbine. One approach is to use a suitable type of fuel-combustion system. Another approach is to use a TSU. While fuel-combustion systems usually emit polluting gases, TSUs may be preferable over fuel-combustion systems at least because they are not associated with such harmful emissions.

Although TSUs may offer advantages over fuel-combustion systems, existing TSUs have several shortcomings, as discussed below.

One known configuration of a TSU is shown in FIG. 1. TSU 10 of FIG. 1 includes heated parallel plates 12 contained within housing 14 to create channels through which compressed air may flow. The heat transfer area and the gap between plates 12 may be adjusted for optimum heat transfer conditions. Such a TSU, however, is not optimally suited for high pressure operation as these plates do not provide optimum pressure containment for the compressed air, and instead result in leakage flow between plates 12 and housing 14.

Another known TSU uses tube flow through elongated cavities embedded in a solid medium. As shown in FIG. 2, compressed air travels through through-holes 22, which are bored out of bar 24. Although tube flow, as provided by TSU 20 of FIG. 2, may provide more desirable pressure containment compared to channel flow TSU 10 of FIG. 1, it involves high fabrication costs. This is because it is usually costly to drill a plurality of small-diameter holes that extend throughout the entire length of a solid medium.

Therefore, it can be seen that the TSUs shown in FIGS. 1 and 2 fail to provide means for effectively containing and delivering hot and compressed air in a manner that is cost beneficial.

In view of the foregoing, it is an object of this invention to provide a low-cost TSU that provides efficient heat storage, heat delivery and pressure containment.

SUMMARY OF THE INVENTION

This and other objects of the present invention are accomplished in accordance with the principles of the present invention by providing a TSU having at least one flow channel disposed annularly about an axis that is substantially parallel to the TSU's longitudinal axis. The annular channel may be contained between an inner member and an outer member, both of which may include thermal mass or thermal storage material having desirable energy or heat storage properties and may be fabricated using standard mill products. The annular channel may be coupled to a port on each end of the channel for either providing fluid thereto or projecting fluid therefrom. In one embodiment of the present invention, the TSU may include a single annular flow channel disposed about the TSU's longitudinal axis. In another embodiment of the present invention, the TSU may include multiple parallel annular flow channels, each being contained between the outer member and a different inner member.

The inner and outer members of the TSU may be heated to effectively heat a fluid flowing through the annular channel. Efficient heat transfer is realized with the annular channel because the ring-like channel maximizes the surface area of fluid contact with the inner and outer members. In addition to providing energy storage and efficient heat transfer, the outer member provides structural support for the TSU, thereby enabling it to contain pressurized fluids. For example, the TSU may be used in a TACAS system whereby compressed air may be sensibly heated in the TSU. The heated and compressed air may then drive a turbine which powers an electrical generator to provide an electrical output.

BRIEF DESCRIPTION OF THE DRAWINGS

The above and other features of the present invention, its nature and various advantages will be more apparent upon consideration of the following detailed description, taken in conjunction with the accompanying drawings, in which like reference characters refer to like parts throughout, and in which.

DETAILED DESCRIPTION OF THE INVENTION

Figure 3:
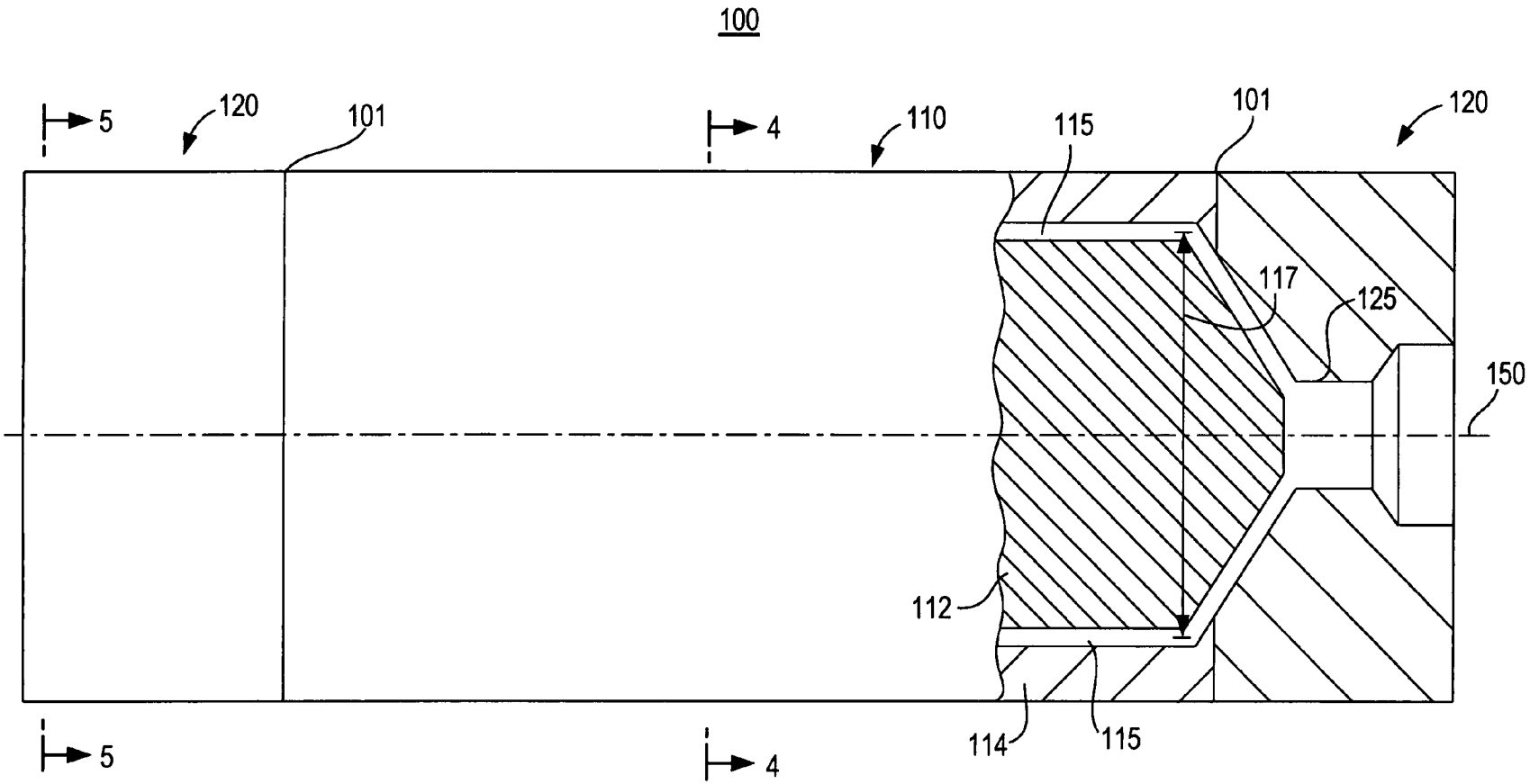
FIG. 3 is a partial sectional view of a thermal storage unit in accordance with the principles of the present invention.

FIG. 3 depicts an embodiment of thermal storage unit (TSU) 100, in accordance with the principles of the present invention. TSU 100 may be cylindrical in shape and may have longitudinal axis 150. Persons skilled in the art will appreciate that the general shape of TSU 100 is not limited to cylinders and may be constructed to fulfill any design criteria.

TSU 100 may include three main compartments, namely, middle portion 110 and end portions 120. Middle portion 110 may be defined as the portion of TSU 100 that is between lines 101, whereas end portions 120 may be defined as the portions of TSU 100 that extend beyond lines 101 to both ends of TSU 100. When fluid is applied to TSU 100, it is directed into one of end portions 120, flows through middle portion 110, and is directed out of the other end portion 120. Fluid may be matter in the liquid, gas or plasma phase.

When fluid is routed through middle portion 110, it flows in a ring-like channel, which is referred to as annular flow channel 115. Annular channel 115 may extend generally along middle portion 110, between outer member 114 and inner member 112. Annular channel 115 may extend along the length of middle portion 110, in a direction that is substantially parallel to longitudinal axis 150.

Figure 4:
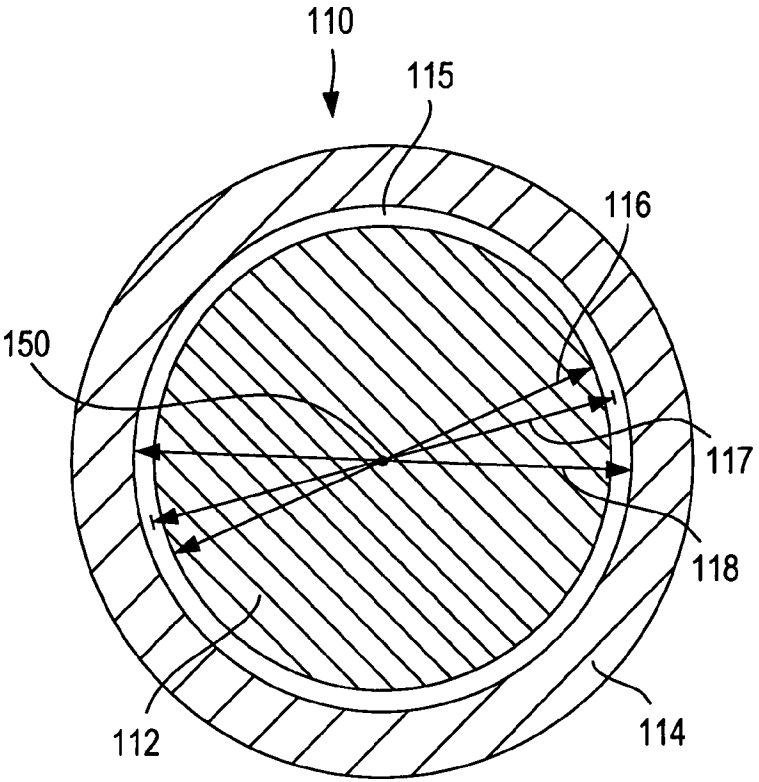
FIG. 4 is a cross-sectional view of the thermal storage unit of FIG. 3, taken generally from line 4—4 of FIG. 3.

FIG. 4 shows a cross-sectional view taken along line 4—4 of FIG. 3. Annular channel 115 may have an inner diameter and an outer diameter. Inner diameter 116 and outer diameter 118 of FIG. 4 define the cross-sectional area of annular channel 115. The portion of inner member 112 contained in middle portion 110 may have a cylindrical outer surface, thereby providing a basis for inner diameter 116 of annular channel 115 (i.e. the diameter of inner member 112). Similarly, the inner surface of outer member 114, which may be cylindrically shaped and which is contained in middle portion 110, provides a basis for outer diameter 118 of annular channel 115 (i.e. the diameter of outer member 114). The length of a mean diameter (depicted by dotted line 117) of annular channel 115 may be calculated as the mean value of the length of inner and outer diameters 116 and 118.

Referring back to FIG. 3, because inner member 112 extends partially into end portions 120, and because outer member 114 extends through the entire length of TSU 100, annular channel 115 may also partially extend into end portions 120. Starting approximately at each end of middle portion 110, mean diameter 117 of annular channel 115 may taper into end portion 120, in a direction parallel to longitudinal axis 150.

Figure 5:
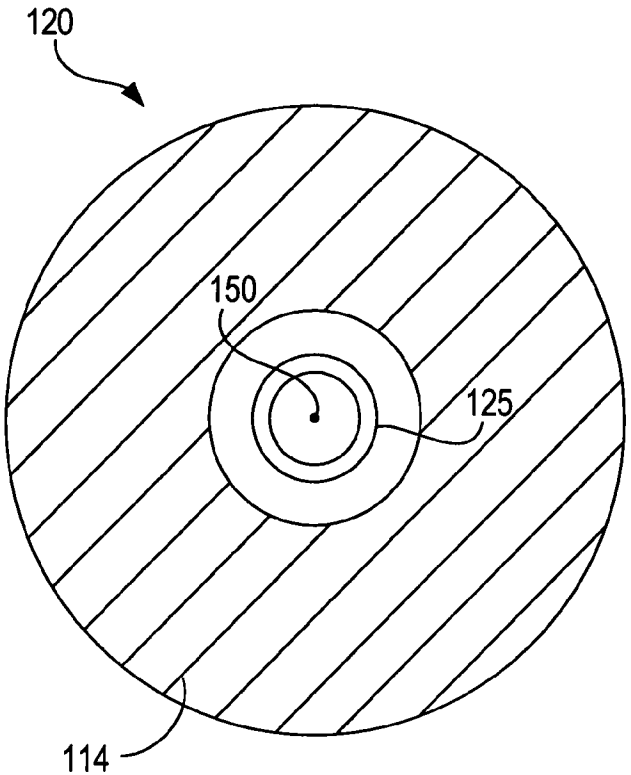
FIG. 5 is a cross-sectional view of the thermal storage unit of FIG. 3, taken generally from line 5—5 of FIG. 3.

End portions 120, which may be identical, may each include a hollow or tubular enclosure, namely, port 125, within a portion of outer member 114 that extends into each of the end portions. Port 125 may be coupled to the portion of annular channel 115 that extends into the end portion for either providing fluid thereto or projecting fluid therefrom. In this arrangement, annular channel 115 may decrease in mean diameter from a point within TSU 100 (e.g., a point proximal to line 101) to the point on the end portion where port 125 couples to annular channel 115. This arrangement enables fluid delivery to and from the TSU. Port 125 may be also seen in FIG. 5, which shows a cross-sectional view taken along line 5—5 of FIG. 3. Port 125 may be a tubular aperture (e.g., an inlet or outlet) for facilitating the delivery or projection of fluid to or from TSU 100.

In a preferred embodiment of the present invention, inner member 112 may be constructed from solid material(s) that have adequate thermal conductivity and other desirable thermal properties such as high volumetric heat capacity. Outer member 114 may be constructed from the same material(s) as inner member 112. Therefore, both inner and outer members 112 and 114 may provide thermal mass for energy storage. Alternatively, outer member 114 may be constructed from material(s) capable of withstanding high pressure, in addition to possessing desirable thermal properties. Such materials may include iron, steel, aluminum, any alloys thereof or any other suitable material(s).

According to the principles of the present invention, TSU 100 may be heated to a desired temperature by heating inner and outer members 112 and 114. Fluid may then be heated by routing it through TSU 100 such that it enters one of ports 125 at one end, flows through annular channel 115, and exits through port 125 at the opposite end.

Inner member 112 and/or outer member 114, may be heated through radiation by means of an external or internal heater. For example, a ceramic fiber heater that annularly surrounds—without coming into contact with—TSU 100 may heat both inner and outer members 112 and 114 through radiation when actuated. Alternatively, one or more heating rods may be placed into one or more cavities extending through at least a portion of or the entire length of TSU 100. When such heating rods are actuated, they radiate heat energy to heat both inner and outer members 112 and 114.

Due to the thermal conductivity of the inner and outer members 112 and 114, heat energy is effectively conducted through these members. Moreover, because annular channel 115 maximizes the surface area of fluid contact with the thermal mass in inner and outer members 112 and 114, the fluid flowing in the channel may be sensibly heated through convection from inner member 112 and/or outer member 114 to the fluid. Accordingly, heating either member or both enables the efficient heating of the fluid flowing through the channel. Thus, when fluid having a predetermined temperature (e.g., ambient temperature) is supplied to TSU 100, its temperature rises as it flows through annular channel 115 formed between inner and outer members 112 and 114.

Persons skilled in the art will appreciate that electronic circuitry (not shown) may be used to monitor the temperature of TSU 100 and control the mechanism (e.g., the external ceramic heater or internal heating rods) used to heat TSU 100. A more detailed discussion of such electronics is provided below in connection with FIG. 8.

Figure 1:
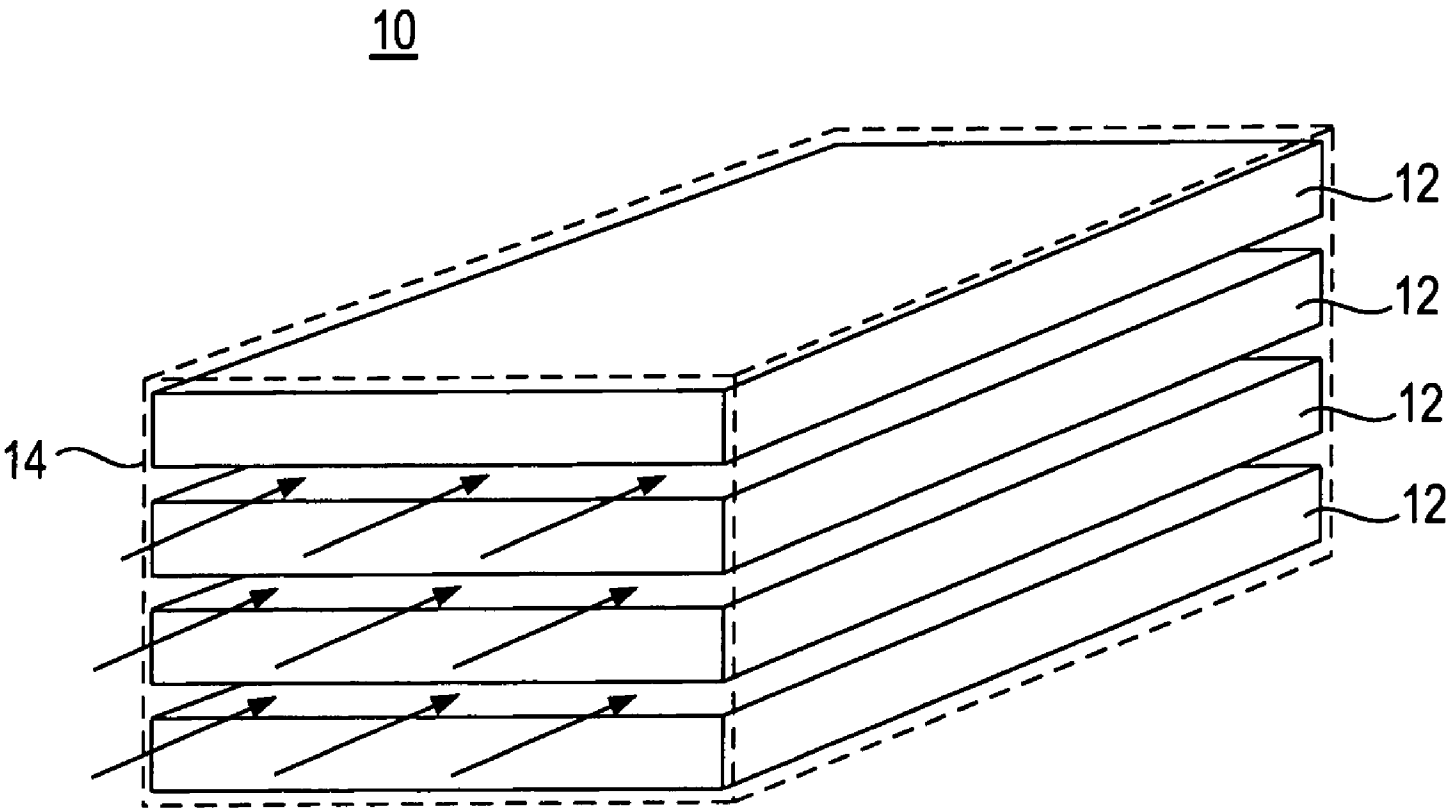
(PRIOR ART) FIG. 1
FIG. 1 is a top perspective view of a known thermal storage unit.

An example of a fluid that may be routed through TSU 100 is compressed air. Compressed air may be heated using TSU 100, as discussed above. Moreover, TSU 100 provides structural integrity against pressure exerted from the compressed air flowing in the channel. This is due to the fact that outer member 114, which contains material capable of withstanding high pressure, cylindrically surrounds the annular channel, thereby containing the pressure exerted by the air on the outer member. Therefore, not only is TSU 100 adequate for providing heat storage, TSU 100 is conducive to high pressure operation, unlike the parallel-plate channel flow TSU 10 of FIG. 1.

Figure 2:
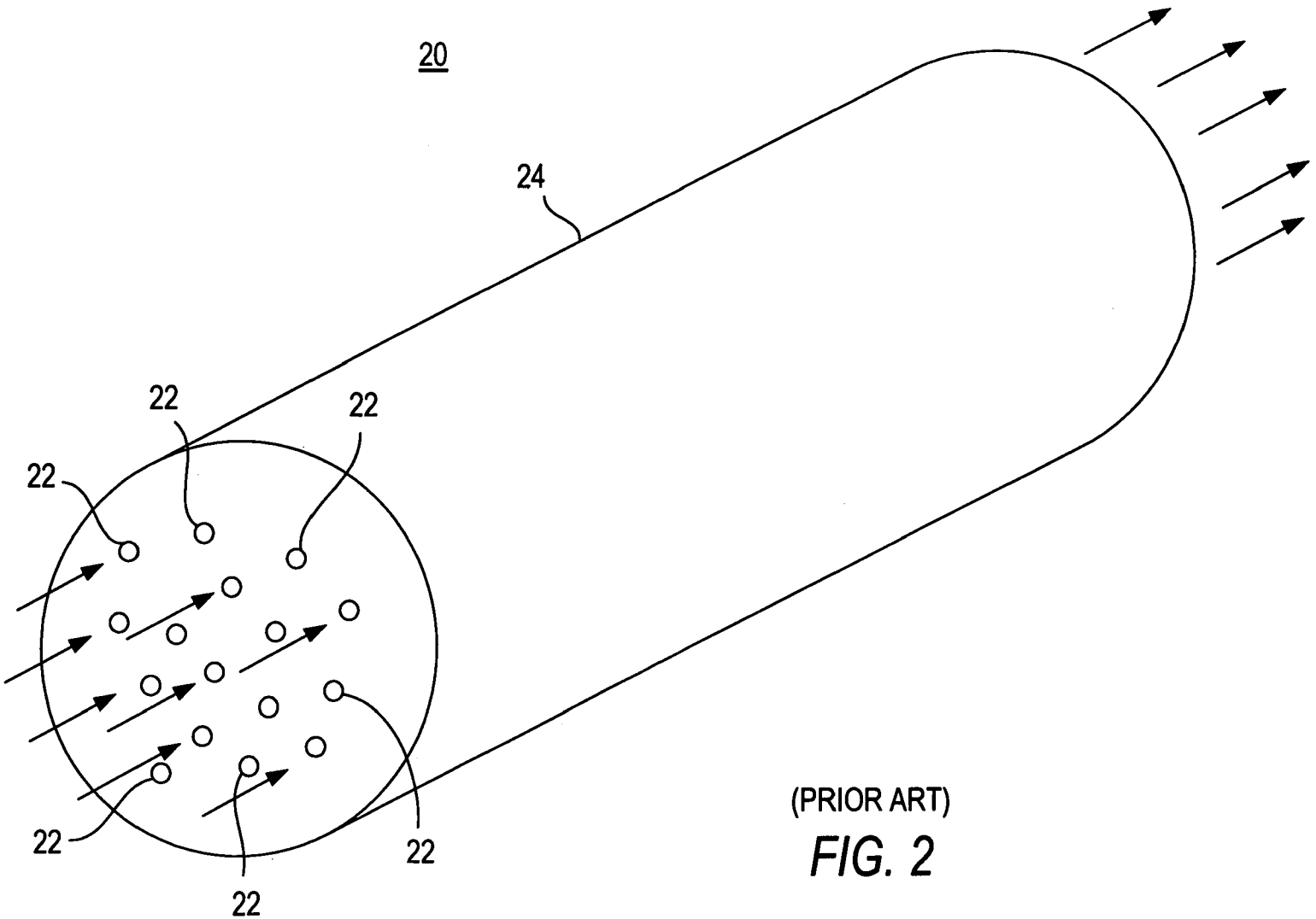
(PRIOR ART) FIG. 2
FIG. 2 is a top perspective view of another known thermal storage unit.

Moreover, unlike drilling multiple small-diameter holes that extend through the entire length of a bar in order to implement tube flow as shown in connection with TSU 20 of FIG. 2, fabricating TSU 100 may be significantly easier and less costly. This is because TSU 100 may be fabricated using conventional mill products having cylindrical shapes such as pipes, tubes and round bars. For example, inner member 112 may be a round bar that is machined to achieve the desired diameter and profile.

Figure 6:
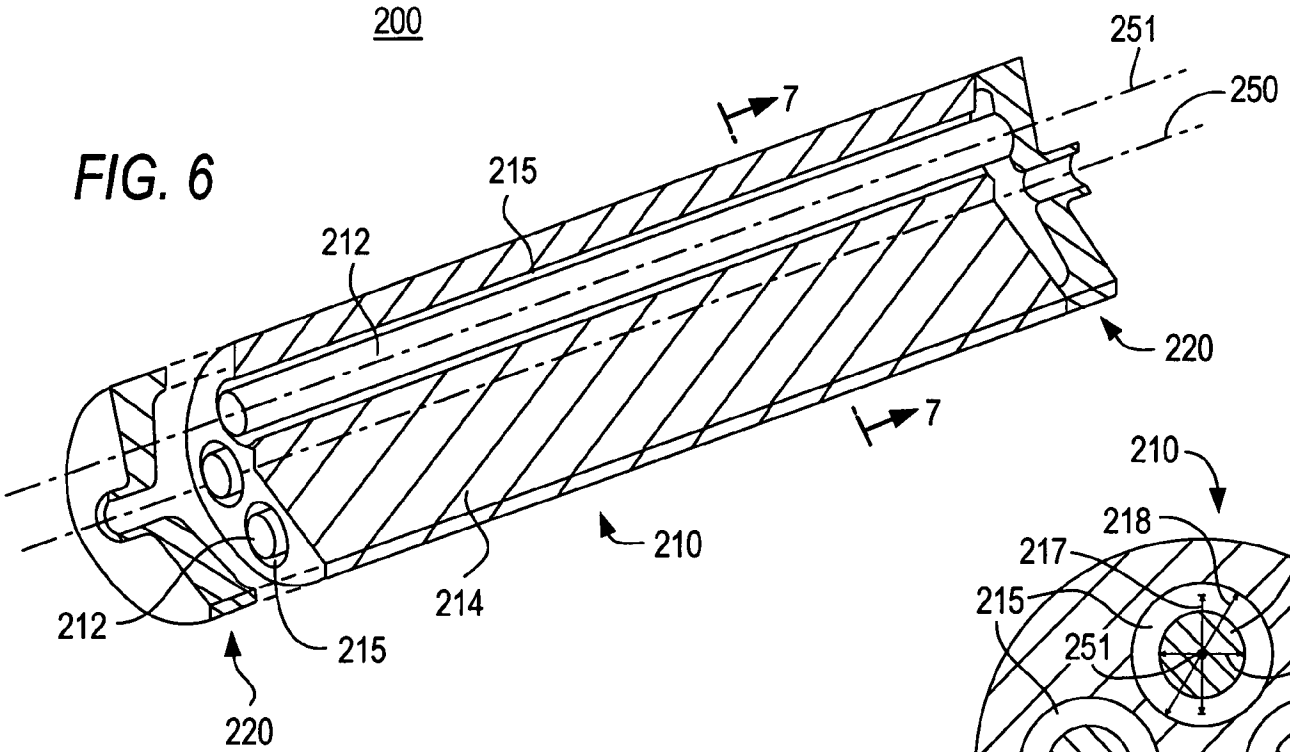
FIG. 6 is a partial perspective view of another thermal storage unit in accordance with the principles of the present invention.
Figure 7:
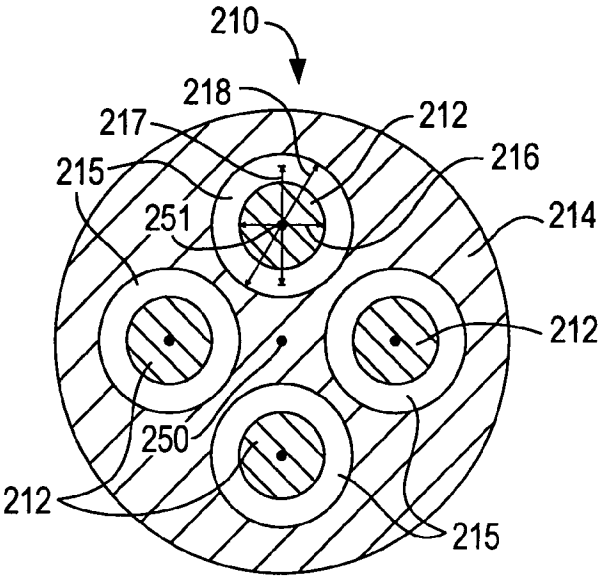
FIG. 7 is a cross-sectional view of the thermal storage unit of FIG. 6, taken generally from line 7—7 of FIG. 6.

FIG. 6 depicts an alternative embodiment of thermal storage unit (TSU) 200 that utilizes multiple annular flow channels, in accordance with the principles of the present invention. TSU 200 may be cylindrical in shape and may have longitudinal axis 250. Persons skilled in the art will appreciate that the general shape of TSU 200 is not limited to cylinders and may be constructed to fulfill any design criteria.

Like TSU 100 of FIG. 3, TSU 200 may include three main compartments, namely, middle portion 210 and end portions 220. End portions 220, which may be identical, may each include a hollow or tubular enclosure, namely, port 225, for either providing fluid to middle portion 210 or projecting fluid therefrom. When fluid is routed through middle portion 210, it flows through multiple annular flow channels 215.

Annular flow channels 215 may be parallel to one another and may extend generally along middle portion 210.

Each one of annular channels 215 may be disposed annularly about an axis that is substantially parallel to longitudinal axis 250, such as axis 251. Each annular channel 215 may be formed by drilling or casting a relatively large-diameter hole in a round bar, which may be referred to as outer member 214, and inserting a smaller round bar, which may be referred to as inner member 212, such that each inner member 212 extends at least along the length of middle portion 210. Because the holes in outer member 214 are relatively large, at least compared to the holes bored through TSU 20 of FIG. 2, TSU 200 can be fabricated relatively easily using conventional mill products. Not only does TSU 200 benefit from ease of manufacturing, it also provides efficient energy storage, heat transfer and pressure containment consistent with that discussed above in connection with TSU 100 of FIG. 1.

Figure 8:
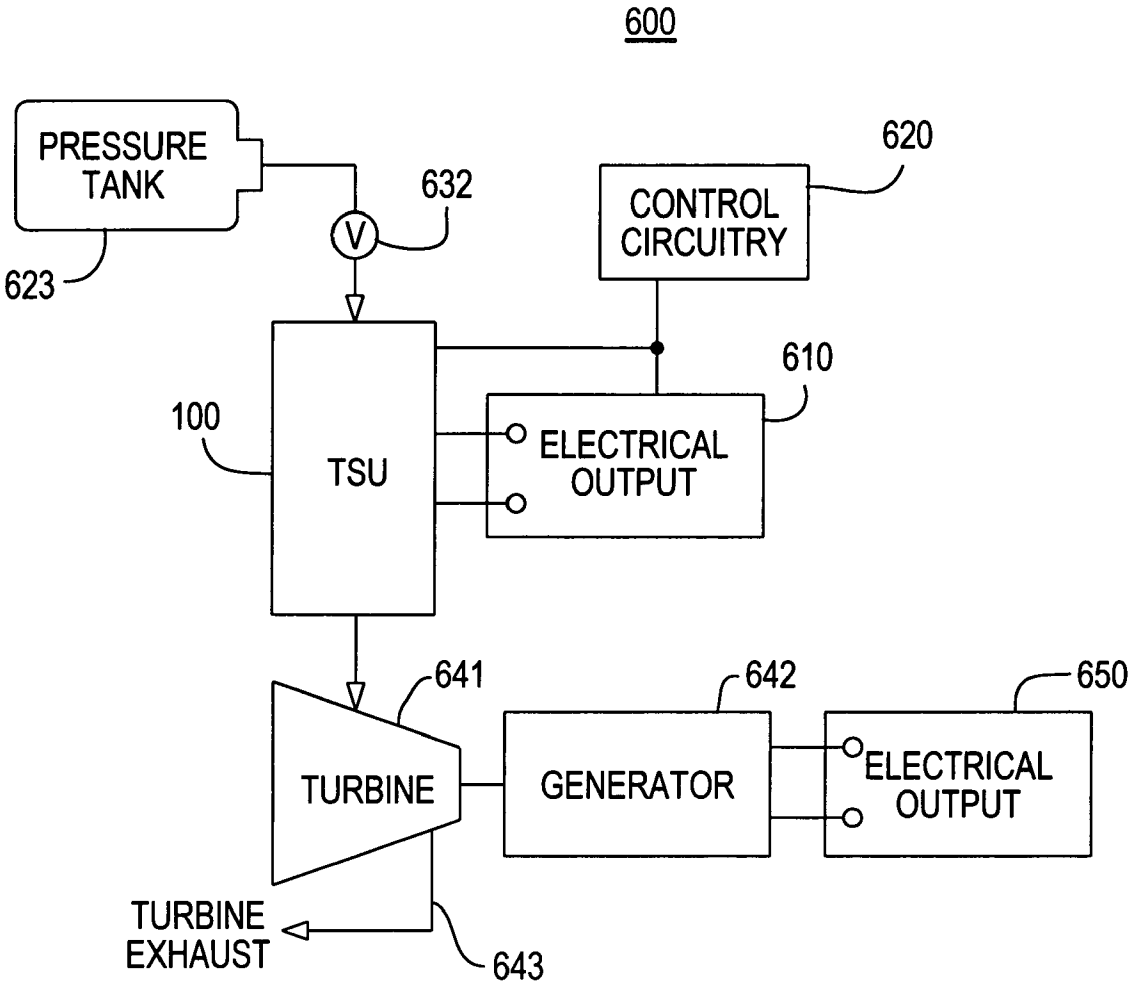
FIG. 8 is a partial schematic diagram of a thermal and compressed air storage system employing a thermal storage unit in accordance with the principles of the present invention.

FIG. 8 shows a cross-sectional view taken along line 7—7 of FIG. 6. Each one of annular channels 215 may be formed between the inner cylindrical surface of a hole in outer member 214 and the outer cylindrical surface of one of inner members 212. Each inner cylindrical surface in outer member 214 provides a basis for outer diameter 218 in one of the annular channels, while each outer cylindrical surface of inner members 212 provides a basis for inner diameter 216 in the same annular flow channel. The length of a mean diameter (depicted by dotted line 217) of each annular channel 215 may be calculated as the mean value of the length of inner and outer diameters 216 and 218 for the annular channel.

In a preferred embodiment of the present invention, each mean diameter of annular channels 215 may be substantially equal in length. Moreover, inner and outer members 212 and 214 may be constructed from the same material as members 112 and 114 of TSU 100 of FIG. 3, and may be heated using the same means described for heating TSU 100. Fluid may therefore be heated by routing it through heated TSU 200 such that it enters one of ports 225 at one end, flows through annular channel 215, and exits through port 225 at the opposite end.

The present invention may be used in many applications. FIG. 8 illustrates one such application. More specifically, FIG. 8 shows a thermal and compressed air storage (TACAS) system 600 for providing output power utilizing TSU 100 of FIG. 3, described above. For example, FIG. 8 may represent a backup energy system that provides backup power to a load in the event of a disturbance in the supply of power from another power source (e.g., utility power failure.) Naturally, TSU 200 of FIG. 6 may be used instead of TSU 100 in TACAS system 600.

The following discussion of TACAS system 600 is not intended to be a thorough explanation of the components of a TACAS, but rather an illustration of how TSU 100 or 200 can enhance the performance of a TACAS system. For a detailed description of a TACAS system, see commonly-assigned, co-pending U.S. patent application Ser. No. 10/361,728, filed Feb. 5, 2003, which is hereby incorporated by reference herein in its entirety.

As shown in FIG. 8, TACAS system 600 includes storage or pressure tank 623, valve 632, TSU 100, electrical input 610, turbine 641, generator 642 and electrical output 650. When electric power is needed from system 600, compressed air from pressure tank 623 may be routed through valve 632 to TSU 100. TSU 100 may heat the compressed air before it is provided to turbine 641.

The hot air emerging from TSU 100 may flow against the turbine rotor (not shown) of turbine 641 and drive turbine 641, which may be any suitable type of turbine system (e.g., a radial-flow turbine). In turn, turbine 641 may drive electrical generator 642, which produces electric power and provides it to electrical output 650.

Also shown in FIG. 8 is turbine exhaust 643 (e.g., the exhaust gases emerging from turbine 641). Turbine exhaust 643 may be vented through an exhaust pipe (not shown), or simply released to recombine with atmospheric air.

Not only is system 600 advantageous because it uses a relatively inexpensive and efficient TSU, it is also non-polluting. That is because, unlike conventional systems that use fuel-combustion systems to provide hot air to the turbine, it does not require a fuel supply to heat the air that is being supplied to turbine 641. Instead, TSU 100 may be powered by electrical input 610, which provides the energy needed to heat the compressed air, while providing effective pressure containment. For example, TSU 100 may include an external or internal radiant heater, as discussed above, which may be powered by electrical input 610. System 600 therefore provides the benefits of heating compressed air from pressure tank 623 before it is supplied to turbine 641, without producing the harmful emissions associated with combustion systems.

It will also be understood by persons skilled in the art that, alternatively, the thermal storage material of TSU 100 may be heated by any other suitable type of heating system. For example, a resistive heater may provide a heat source that is in physical contact with the thermal storage material of TSU 100 and may heat this material to a predetermined temperature. Alternatively, electrically conductive thermal storage materials, such as iron, may be heated inductively using induction heating circuitry that causes current to circulate through and heat the thermal storage material of TSU 100. Thus, the invention is not limited to the specific heating manners discussed above.

TACAS system 600 may also include control circuitry 620 which may be coupled to both TSU 100 and electrical input 610. Control circuitry 620 may include means for measuring the temperature of TSU 100. Control circuitry 620 may also include electric circuitry for controlling the temperature of TSU 100. Control circuitry 620 may control the temperature of TSU 100 by, for example, controlling the electric power provided to the heat source. This may be achieved by providing instructions to electrical input 610, such as instructions to activate, deactivate, increase or decrease the output of electrical input 610. Control circuitry 620, along with electrical input 610, may therefore be used to monitor and control the temperature of TSU 100. As a result, the TSU 100 may be heated to and maintained at a desired temperature.

Moreover, valve 632 may be coupled to piping (not shown) that bypasses TSU 100 and feeds into turbine 641 along with the output from TSU 100. By controlling the portion of the total compressed air flow through the TSU, the ratio of heated to non-heated air provided to turbine 641 may be modified, thereby providing another means for controlling the temperature of the air being supplied to the turbine.

Another advantage of utilizing TSU 100 is that larger pressure tanks are not required as is the case with compressed air storage systems that do not utilize thermal storage units or combustion systems.

The present invention was presented in the context of industrial backup utility power. Alternatively, the present invention may be used in any application associated with generating power, such as in thermal and solar electric plants. Furthermore, the present invention may be used in any other application where thermal storage, fluid heating or heated fluid delivery may be desirable.

The above described embodiments of the present invention are presented for purposes of illustration and not of limitation, and the present invention is limited only by the claims which follow.

What is claimed is:

1. A thermal storage unit having a longitudinal axis, said unit comprising:

an annular flow channel disposed about an axis parallel to the longitudinal axis, said channel being formed between an inner cylindrical surface of a first member and an outer cylindrical surface of a second member, said outer cylindrical surface having a diameter smaller than said inner cylindrical surface;

a tubular inlet coupled to one end of said channel, said inlet for providing fluid to said channel; and a tubular outlet coupled to the other end of said channel; and at least one heat source for heating said members, wherein said at least one heat source comprises induction heating circuitry for causing current to circulate through said first and second members, whereby the circulating current heats said members.

2. A backup energy system comprising:

a thermal storage unit having a longitudinal axis, said unit comprising:

an annular flow channel disposed about an axis parallel to the longitudinal axis, said channel being formed between an inner cylindrical surface of a first member and an outer cylindrical surface of a second member, said outer cylindrical surface having a diameter smaller than said inner cylindrical surface;

a tubular inlet coupled to one end of said channel, said inlet for providing fluid to said channel; and a tubular outlet coupled to the other end of said channel;

a turbine coupled to said thermal storage unit for receiving said heated fluid, said received heated fluid driving said turbine; and an electrical generator for providing power when said turbine is driven by said heated fluid.

3. The backup energy system of claim 2 further comprising a bypass valve coupled to said thermal storage unit, said bypass valve for controlling a portion of said fluid provided to said thermal storage unit.

4. The thermal storage unit of claim 2, wherein said axis parallel to said longitudinal axis comprises said longitudinal axis.

5. The backup energy system of claim 2 further comprising a heating system for heating said thermal storage unit.

6. The backup energy system of claim 5 further comprising control circuitry coupled to said heating system and said thermal storage unit, said control circuitry for controlling said heating system to maintain said thermal storage unit at a predetermined temperature.

7. The backup energy system of claim 2, wherein said fluid is compressed air, said backup energy system further comprising a compressed air system to provide said compressed air to said thermal storage unit.

8. The backup energy system of claim 7, wherein said compressed air system is a storage tank that contains said compressed air.

9. The thermal storage unit of claim 2, wherein said annular flow channel is a first annular flow channel, said axis parallel to said longitudinal axis is a first axis, said inner cylindrical surface of said first member is a first inner cylindrical surface, said thermal storage unit further comprising a second annular flow channel disposed about a second axis parallel to said longitudinal axis, said second channel being formed between a second inner cylindrical surface of said first member and an outer cylindrical surface of a third member, said outer cylindrical surface of said third member having a diameter smaller than said second inner cylindrical surface.

10. The thermal storage unit of claim 9, wherein said diameters of said outer cylindrical surfaces of said second and third members are substantially equal.

11. The thermal storage unit of claim 9, wherein said first and second inner cylindrical surfaces have diameters that are substantially equal.

12. The thermal storage unit of claim 2 further comprising at least one heat source for heating said members.

13. The thermal storage unit of claim 12, wherein said at least one heat source comprises an external radiant heater.

14. The thermal storage unit of claim 12, wherein said at least one heat source comprises an internal radiant heater.

15. The thermal storage unit of claim 12, wherein said at least one heat source comprises a resistive heater.

16. The thermal storage unit of claim 12, wherein said at least one heat source is coupled to control circuitry, said control circuitry for controlling said at least one heat source to maintain said unit at a predetermined temperature.

17. The thermal storage unit of claim 2, wherein each of said first and second members comprises thermal storage material.

18. The thermal storage unit of claim 17, wherein said thermal storage material comprises a solid mass.

19. The thermal storage unit of claim 18, wherein said solid mass is iron.

20. The thermal storage unit of claim 18, wherein said solid mass is aluminum.

21. The thermal storage unit of claim 18, wherein said solid mass is steel.

22. The thermal storage unit of claim 18, wherein said solid mass includes a material that is selected from the group consisting of iron, steel, aluminum and any alloys thereof.

23. A backup energy system comprising:

a thermal storage unit, having a longitudinal axis, that heats fluid flowing through said unit, comprising:

a first member having an outer diameter;

a second member having an inner diameter that is larger than said outer diameter;

an annular flow channel disposed about said axis and formed between said first and second members, wherein said first member is positioned within said second member;

an inlet coupled to one end of said channel that provides fluid to said channel;

an outlet coupled to the other end of said channel; and at least one heat source that heats said first and second members;

a turbine coupled to said thermal storage unit for receiving said heated fluid, said received heated fluid driving said turbine; and an electrical generator for providing power when said turbine is driven by said heated fluid.

24. The backup energy system of claim 23, wherein said at least one heat source comprises an external radiant heater.

25. The backup energy system of claim 23, wherein said at least one heat source comprises an internal radiant heater.

26. The backup energy system of claim 23, wherein said at least one heat source comprises a resistive heater.

27. The backup energy system of claim 23, wherein said at least one heat source is coupled to control circuitry, said control circuitry for controlling said at least one heat source to maintain said unit at a predetermined temperature.

28. The backup energy system of claim 23, wherein each of said first and second members comprises thermal storage material.

29. The backup energy system of claim 28, wherein said thermal storage material comprises a solid mass.

30. The backup energy system of claim 29, wherein said solid mass is iron.

31. The backup energy system of claim 29, wherein said solid mass is aluminum.

32. The backup energy system of claim 29, wherein said solid mass is steel.

33. The backup energy system of claim 29, wherein said solid mass includes a material that is selected from the group consisting of iron, steel, aluminum and any alloys thereof.

34. A thermal storage unit having a longitudinal axis, said unit comprising:

a port disposed at a first end of said unit; and a flow channel disposed annularly about said longitudinal axis, said annular channel being coupled to said port at a first point on said unit proximal to said first end, said annular channel having a diameter that tapers generally from a second point on said unit to said first point along said longitudinal axis.

35. The thermal storage unit of claim 34, wherein said port is a first port, said unit further comprising:

a second port disposed at a second end of said unit, said annular channel being coupled to said second port at a third point on said unit proximal to said second end, said diameter of said annular channel tapering generally from a fourth point on said unit to said third point along said longitudinal axis.

36. The thermal storage unit of claim 34 further comprising at least one heat source for heating a fluid flowing through said annular channel.

37. The thermal storage unit of claim 36, wherein said at least one heat source comprises an external radiant heater.

38. The thermal storage unit of claim 36, wherein said at least one heat source comprises an internal radiant heater.

39. The thermal storage unit of claim 36, wherein said at least one heat source comprises a resistive heater.

40. The thermal storage unit of claim 36, wherein said at least one heat source is coupled to control circuitry, said control circuitry for controlling said at least one heat source to maintain said unit at a predetermined temperature.

41. The thermal storage unit of claim 34 further comprising a thermal storage material.

42. The thermal storage unit of claim 41, wherein said thermal storage material comprises a solid mass.

43. The thermal storage unit of claim 42, wherein said solid mass is iron.

44. The thermal storage unit of claim 42, wherein said solid mass is aluminum.

45. The thermal storage unit of claim 42, wherein said solid mass is steel.

46. A thermal storage unit having a longitudinal axis, said unit comprising:

a thermal storage material;

a port disposed at a first end of said unit; and a flow channel disposed annularly about said longitudinal axis, said annular channel being coupled to said port at a first point on said unit proximal to said first end, said annular channel having a diameter that tapers generally from a second point on said unit to said first point along said longitudinal axis, at least one heat source for heating a fluid flowing through said annular channel, wherein said at least one heat source comprises induction heating circuitry for causing current to circulate through said first and second members, whereby the circulating current heats said thermal storage material.

47. A backup energy system comprising:

a thermal storage unit having a longitudinal axis, said unit comprising:

a port disposed at a first end of said unit; and a flow channel disposed annularly about said longitudinal axis, said annular channel being coupled to said port at a first point on said unit proximal to said first end, said annular channel having a diameter that tapers generally from a second point on said unit to said first point along said longitudinal axis;

a turbine coupled to said thermal storage unit for receiving said heated fluid, said received heated fluid driving said turbine; and an electrical generator for providing power when said turbine is driven by said heated fluid.

48. The backup energy system of claim 47 further comprising a bypass valve coupled to said thermal storage unit, said bypass valve for controlling a portion of said fluid provided to said thermal storage unit.

49. The backup energy system of claim 47 further comprising a heating system for heating said thermal storage unit.

50. The backup energy system of claim 49 further comprising control circuitry coupled to said heating system and said thermal storage unit, said control circuitry for controlling said heating system to maintain said thermal storage unit at a predetermined temperature.

51. The backup energy system of claim 47, wherein said fluid is compressed air, said backup energy system further comprising a compressed air system to provide said compressed air to said thermal storage unit.

52. The backup energy system of claim 51, wherein said compressed air system is a storage tank that contains said compressed air.

53. A thermal storage unit having a longitudinal axis, said unit comprising:

a first annular flow channel disposed about a first axis parallel to said longitudinal axis, said first channel being formed between a first inner cylindrical surface of a first member and an outer cylindrical surface of a second member, said outer cylindrical surface of said second member having a diameter smaller than said first inner cylindrical surface; and a second annular flow channel disposed about a second axis parallel to said longitudinal axis, said second channel being formed between a second inner cylindrical surface of said first member and an outer cylindrical surface of a third member, said outer cylindrical surface of said third member having a diameter smaller than said second inner cylindrical surface, at least one heat source for heating fluid provided to said first and second channels, wherein said at least one heat source comprises induction heating circuitry for causing current to circulate through said first, second and third members, whereby the circulating currents heat said members.

54. A thermal storage unit, having a longitudinal axis, that heats fluid flowing through said unit, comprising:

a first member having an outer diameter;

a second member having an inner diameter that is larger than said outer diameter;

an annular flow channel disposed about said axis and formed between said first and second members, wherein said first member is positioned within said second member;

an inlet coupled to one end of said channel that provides fluid to said channel;

an outlet coupled to the other end of said channel; and at least one heat source that heats said first and second members, wherein said at least one heat source comprises induction heating circuitry for causing current to circulate through said first and second members, whereby the circulating current heats said members.

55. A thermal storage unit, having a longitudinal axis, that heats fluid flowing through said unit, comprising:

a plurality of inner members each having an outer diameter;

an outer member having a plurality of through-holes bored therethrough, each said through-hole having an axis substantially parallel to said longitudinal axis, and wherein each said through-hole has a through-hole diameter that is larger than said outer diameter;

a plurality of annular flow channels disposed about each said through-hole axis, each said channel being formed between one of said plurality of inner members and one of said plurality of through-holes, wherein said each said inner member is positioned within said outer member;

an inlet coupled to one end of said channels that provides fluid to said channels;

an outlet coupled to the other end of said channels; and at least one heat source that heats said plurality of inner members and said outer member, wherein said at least one heat source comprises induction heating circuitry for causing current to circulate through said plurality of inner members and said outer member, whereby the circulating current heats said members.

56. A method for using a thermal storage unit in a backup power delivery system that uses fluid to provide electrical power, the method comprising:

preheating first and second members of said unit to a predetermined temperature;

providing fluid to said unit in the event of failure of a primary power source;

heating said fluid as said fluid passes through an annular channel that is formed between said first and second members; and using said heated fluid to drive a turbine, which drives an electrical generator to provide electrical power.

57. The method of claim 56 further comprising controlling application of heat to said first and second members to maintain said thermal storage unit at a predetermined temperature.

58. A backup energy system comprising:

thermal storage unit having a longitudinal axis, said unit comprising:

a first annular flow channel disposed about a first axis parallel to said longitudinal axis, said first channel being formed between a first inner cylindrical surface of a first member and an outer cylindrical surface of a second member, said outer cylindrical surface of said second member having a diameter smaller than said first inner cylindrical surface; and a second annular flow channel disposed about a second axis parallel to said longitudinal axis, said second channel being formed between a second inner cylindrical surface of said first member and an outer cylindrical surface of a third member, said outer cylindrical surface of said third member having a diameter smaller than said second inner cylindrical surface;

a turbine coupled to said thermal storage unit for receiving said heated fluid, said received heated fluid driving said turbine; and an electrical generator for providing power when said turbine is driven by said heated fluid.

59. The backup energy system of claim 58 further comprising a bypass valve coupled to said thermal storage unit, said bypass valve for controlling a portion of said fluid provided to said thermal storage unit.

60. The thermal storage unit of claim 58 further comprising:

a tubular inlet coupled to one end of said first and second channel, said inlet for providing fluid to said channel; and a tubular outlet coupled to the other end of said first and second channel.

61. The thermal storage unit of claim 58, wherein the diameters of said outer cylindrical surfaces of said second and third members are substantially equal in length.

62. The thermal storage unit of claim 58, wherein said first and second inner cylindrical surfaces have diameters that are substantially equal in length.

63. The backup energy system of claim 58 further comprising a heating system for heating said thermal storage unit.

64. The backup energy system of claim 63 further comprising control circuitry coupled to said heating system and said thermal storage unit, said control circuitry for controlling said heating system in order to maintain said thermal storage unit at a predetermined temperature.

65. The backup energy system of claim 58, wherein said fluid is compressed air, said backup energy system further comprising a compressed air system to provide said compressed air to said thermal storage unit.

66. The backup energy system of claim 65, wherein said compressed air system is a storage tank that contains said compressed air.

67. The thermal storage unit of claim 58 further comprising at least one heat source for heating fluid provided to said first and second channels.

68. The thermal storage unit of claim 67, wherein said at least one heat source comprises an external radiant heater.

69. The thermal storage unit of claim 67, wherein said at least one heat source comprises an internal radiant heater.

70. The thermal storage unit of claim 67, wherein said at least one heat source comprises a resistive heater.

71. The thermal storage unit of claim 67, wherein said at least one heat source is coupled to control circuitry, said control circuitry for controlling said at least one heat source in order to maintain said unit at a predetermined temperature.

72. The thermal storage unit of claim 58, wherein each of said first, second and third members comprises thermal storage material.

73. The thermal storage unit of claim 72, wherein said thermal storage material comprises a solid mass.

74. The thermal storage unit of claim 73, wherein said solid mass is iron.

75. The thermal storage unit of claim 73, wherein said solid mass is aluminum.

76. The thermal storage unit of claim 73, wherein said solid mass is steel.

77. The thermal storage unit of claim 73, wherein said solid mass includes a material that is selected from the group consisting of iron, steel, aluminum and any alloys thereof.

78. A backup energy system comprising:

a thermal storage unit, having a longitudinal axis, that heats fluid flowing through said unit, comprising:

a plurality of inner members each having an outer diameter;

an outer member having a plurality of through-holes bored therethrough, each said through-hole having an axis substantially parallel to said longitudinal axis, and wherein each said through-hole has a through-hole diameter that is larger than said outer diameter;

a plurality of annular flow channels disposed about each said through-hole axis, each said channel being formed between one of said plurality of inner members and one of said plurality of through-holes, wherein said each said inner member is positioned within said outer member;

an inlet coupled to one end of said channels that provides fluid to said channels;

an outlet coupled to the other end of said channels; and at least one heat source that heats said plurality of inner members and said outer member;

a turbine coupled to said thermal storage unit for receiving said heated fluid, said received heated fluid driving said turbine; and an electrical generator for providing power when said turbine is driven by said heated fluid.

79. The backup energy system of claim 78, wherein said at least one heat source comprises an external radiant heater.

80. The backup energy system of claim 78, wherein said at least one heat source comprises an internal radiant heater.

81. The backup energy system of claim 78, wherein said at least one heat source comprises a resistive heater.

82. The backup energy system of claim 78, wherein said at least one heat source is coupled to control circuitry, said control circuitry for controlling said at least one heat source to maintain said unit at a predetermined temperature.

83. The backup energy system of claim 78, wherein each of said members comprises thermal storage material.

84. The backup energy system of claim 83, wherein said thermal storage material comprises a solid mass.

85. The backup energy system of claim 84, wherein said solid mass is iron.

86. The backup energy system of claim 84, wherein said solid mass is aluminum.

87. The backup energy system of claim 84, wherein said solid mass is steel.

88. The backup energy system of claim 84, wherein said solid mass includes a material that is selected from the group consisting of iron, steel, aluminum and any alloys thereof.

* * * * *